US005100051A

United States Patent [19]

Triglia et al.

[11] Patent Number: 5,100,051

[45] Date of Patent: Mar. 31, 1992

[54] GIFT WRAPPER

[75] Inventors: Benito Triglia, Peekskill; Joseph Anella, Jr., Brooklyn, both of N.Y.

[73] Assignee: Datg, Inc., Lloyd Harbor, N.Y.

[21] Appl. No.: 646,098

[22] Filed: Jan. 25, 1991

[51] Int. Cl.[5] ..... B65D 65/12

[52] U.S. Cl. ..... 229/87.19; 53/390; 229/923; 383/119

[58] Field of Search ..... 229/87.18, 87.19, 923; 383/119; 53/390, 459

[56] References Cited

U.S. PATENT DOCUMENTS

| | | | |
|---|---|---|---|
| 2,331,966 | 10/1943 | Eisgrav | 383/119 |
| 3,118,588 | 1/1964 | Noble | 383/119 |
| 3,286,907 | 11/1966 | Crane | 229/117.06 |
| 3,394,867 | 7/1968 | Gregg | 229/87.19 |
| 3,459,358 | 8/1969 | Adams, Jr. | 229/87.19 |
| 3,489,333 | 1/1970 | Culberg et al. | 229/923 |
| 3,658,240 | 4/1972 | Stoll | 229/87.19 |
| 3,790,064 | 2/1974 | Kramer | 229/87.19 |
| 4,005,814 | 2/1977 | Foster | 229/87.19 |
| 4,967,952 | 11/1990 | Roessiger | 229/87.19 |

*Primary Examiner*—Stephen P. Garbe
*Attorney, Agent, or Firm*—Jack F. Kramer

[57] ABSTRACT

A pre-formed gift wrapper dimensioned to gift wrap a box of predetermined standard size in a matter of seconds includes a bag-like sleeve of paper which in its operational shape accommodates snugly the box which is inserted into an open end thereof. Cardboard guide and support members are adhered to the inner side walls of the sleeve and reinforce same along the entire width and length of the walls to support the wrapper in its operational shape and continuously guide the box as it is inserted into the wrapper. These members as well as the paper sleeve are scored to enable the ends thereof to be folded flat against the end of the box to completely close the gift wrapper about the box so that it is gift wrapped. Also the paper sleeve is scored to allow folding of the support members to place the wrapper in a flattened condition for storage.

7 Claims, 3 Drawing Sheets

GIFT WRAPPER

BACKGROUND OF THE INVENTION

The present invention relates to preformed wrapping of articles, and more particularly, to a preformed gift wrapper which can be readily utilized to wrap boxes and like articles containing gifts or the like with a minimum of effort, skill and waste, and in minimum amount of time.

To avoid the laborious and relatively costly task of wrapping gifts by first measuring and tearing an adequate amount of decorative paper from a roll, placing it around a box to be wrapped, and securing it by means of a ribbon or adhesive tape, various prefabricated gift wrappers have been devised. Beside the above advantages, the use of such preformed wrappers permit the ordering by stores of standard sizes for standard sized boxes, resulting in more efficient stockable inventory control. Also long lines of people waiting in department stores for packages to be gift wrapped, especially at holiday times, can be considerably reduced, which results in more efficiency and thus more sales. Also a more perfectly wrapped gift will be obtained, even by unskilled people.

One such gift wrapper is disclosed in U.S. Pat. No. 3,658,240 issued Apr. 25, 1972. This gift wrapper comprises a paper sleeve movable from a flattened condition to an operational shape having two ends open to receive a box and cardboard reinforcements in the corners of each end which are situated beyond the box ends when the box is placed midway in the sleeve. To close the wrapper, the reinforcements are folded against the ends of the box. The sleeve is also made such that two ends of the paper are adhered to each other forming a seam substantially in the middle of the top wall of the sleeve. Thus a major drawback of this construction is that there is no protection of the sides of the box when wrapped, and also an imperfect support for the sleeve in its operational shape. More particularly, there is substantially no guidance for the box when it is inserted into the sleeve. As a consequence, the box can be skewed when being slipped into the sleeve, distorting the latter, and causing the seam to tear or come apart, destroying the wrapper.

SUMMARY OF THE INVENTION

It is, therefore a primary object of the present invention to provide a preformed gift wrapper which will not only be fully supported when in an operational shape to receive an article, such as a box, but will provide continuous guidance for the box as it is inserted into the wrapper.

A further object of the Invention is to provide a preformed gift wrapper which will protect the sides as well as at least one end of the box wrapped thereby.

A further object of the invention is to provide a preformed gift wrapper which will not have any seams at locations which are vulnerable to be torn or severed.

A still further object of the invention is to provide a preformed gift wrapper which will have only one open end to be closed, whereby a box can be wrapped even more quickly than heretofore.

These and other objects of the invention are accomplished by providing a preformed bag-like sleeve of sheet material with one closed end and one open end and having a shape and dimensions to snugly accommodate a particular standard sized gift box. The sides of the sleeve have secured thereto guide and support members substantially along the entire length and width thereof and which together with a portion of the sheet material extend beyond the end of a box in the sleeve at the open end thereof. Thus, the protruding ends of these members and the sheet material need only be folded over the adjacent end of the box to complete the gift wrap. The sheet material is scored to enable the sleeve to be folded in a flattened condition for storage and also placed into operational shape to receive the box.

A further embodiment of the invention is to provide a preformed baglike sleeve as above having both ends open with the guide and support members and sheet material protruding at both ends, whereby when these are folded and the ends of the sleeve are closed, both ends of the box will be protected from injury as well as the sides thereof.

BRIEF DESCRIPTION OF DRAWINGS

The invention is illustrated by way of example in the accompanying drawings which form part of this application and in which.

DESCRIPTION OF PREFERRED EMBODIMENTS

Referring to FIGS. 1 to 6 of the drawings, the gift wrapper 10 of the invention is shown in a first embodiment. This gift wrapper is made by fabricating a baglike sleeve 11 from sheet material which is flexible and non-self-supporting such as, for example, decorative, gift wrapping paper, in any known or conventional manner. The size of the bag-like sleeve 11 is chosen to accommodate a gift box 12 having predetermined dimensions. Thus, the sleeve can be pre-made to wrap gift boxes of any standard size or any desired size.

Figure 1:
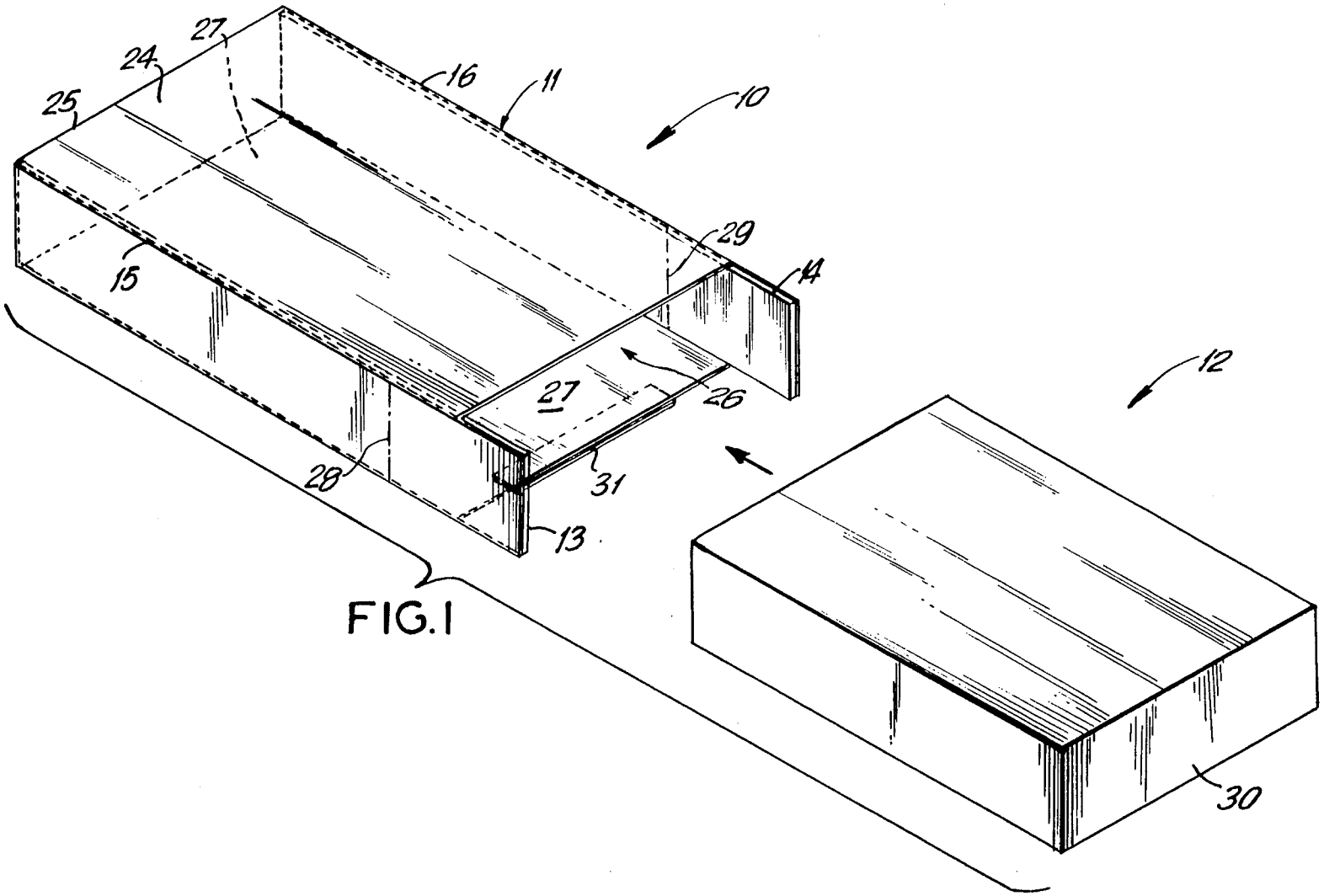
FIG. 1 shows a perspective view of the gift wrapper of the invention ready to receive a box.
Figure 6:
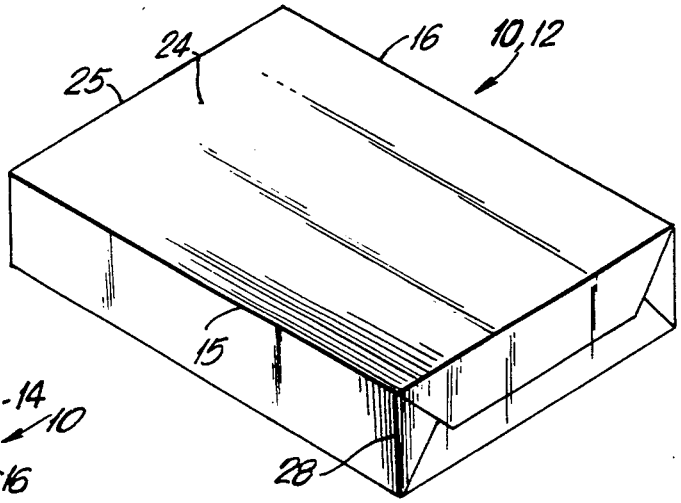
FIG. 6 shows a perspective view of the completed wrapping.

During manufacture of the sleeve 11, two guide and support members 13, 14 of relative stiff material such as cardboard are adhered by adhesive or otherwise secured to inner surface portions of the gift wrapping paper, that is, to portions of the sleeve 11 which will become opposite and parallel inner side walls of the gift wrapper 10 when it is placed in an operational shape to receive the gift box 12 as depicted in FIG. 1. As shown, a cardboard member 13, 14, is glued or otherwise attached to each one of inner walls 15, 16, of sleeve 11 substantially along the entire width and length of the wall 15, 16. These support and guide members 13, 14, thus will not only fully reinforce and support the sleeve 11 in the shape shown in FIG. 1 but will also continuously and smoothly guide box 12 as it is inserted into the gift wrapper 10 so that it will not skew or otherwise place stress on the inner walls of the wrapper. Also when box 12 is wrapped as shown in FIG. 6, its sides will be fully protected against injury by members 13 and 14.

Figure 2:
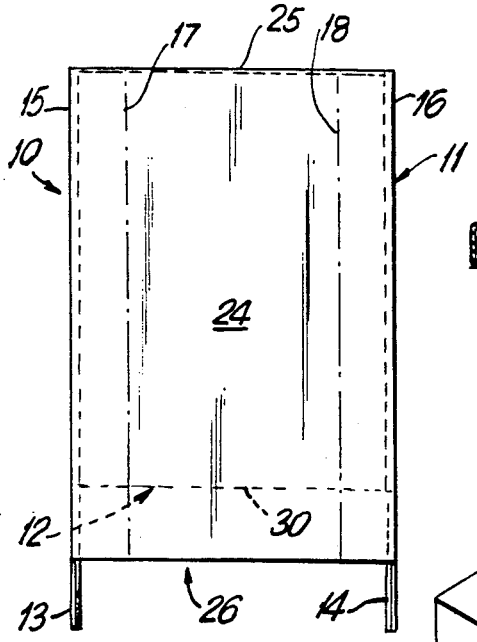
FIG. 2 shows a top view of the gift wrapper of the invention after a box is inserted therein and the score or fold lines on the top wall thereof.
Figure 5:
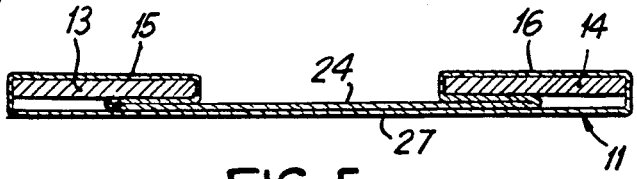
FIG. 5 shows a section of the gift wrapper of the invention shown in FIG. 4 taken on line 5—5.
Figure 3:
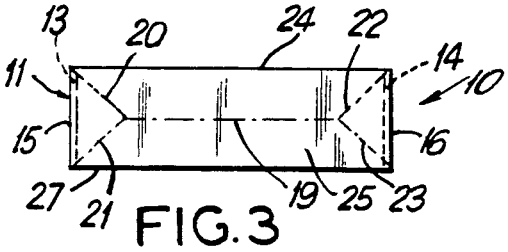
FIG. 3 shows a view of the closed end of the gift wrapper of the invention showing the score or fold lines thereon.
Figure 4:
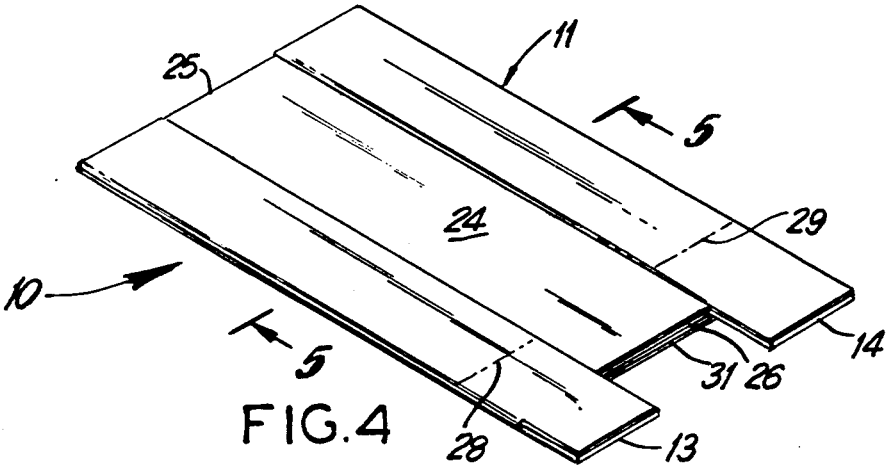
FIG. 4 shows the gift wrapper of the invention in flattened condition for stacking with others for storage.

Also during manufacture of sleeve 11, score or fold lines 17, 18, 19, 20, 21, 22, 23 are provided in the gift wrapping paper on portions which will become respectively the top wall 24 and closed end wall 25 of the gift wrapper 10 when it is placed in its operational shape to receive the gift box 12 as shown in FIG. 1. These score or fold lines are shown in FIGS. 2 and 3 by dot-dash lines. These score or fold lines are located such that the gift wrapper 10 can be folded and moved from its operational shape shown in FIG. 1 to a flattened condition shown in FIG. 4. This is accomplished by folding walls 15, 16 and guide and support members 13 and 14 respectively secured thereto inwardly toward the center of the gift wrapper 10 along score or fold lines 17 and 18, respectively. Also the closed end wall 25 of the gift wrapper 10 will fold along score or fold lines 19, 20, 21, 22 and 23 so that the wrapper will assume the flattened condition of FIG. 4 in which many such wrappers can be stacked one upon the other in a relatively small amount of space.

It will also now be seen that with the construction of the gift wrapper of the invention that the bag-like sleeve 11 can be fabricated with only one open end 26, i.e. the end 25 can be made closed. Thus, box 12 can be simply slipped into the wrapper 10 till it reaches closed end 25 easily and without measuring, whereupon the open end 26 can also be quickly closed as will be presently explained, so that the box can be wrapped in a manner of seconds.

It will be further seen that the gift wrapper 10 of the invention can be constructed so that there is no seam or joining of the paper at locations which are vulnerable to be torn or ripped apart such as in top and bottom walls 24, 27 of the wrapper 10 when a box 12 is being inserted therein. Any necessary seam can be placed at locations which are supported or protected by guide and support members 13, 14.

Referring to FIG. 2, the box 12 is shown inside the gift wrapper 10 and the dash lines show the end of the box 12. It will be apparent that the guide and support members 13, 14, are made with a length to protrude beyond the end of the box 12 when it is placed in wrapper 10. It will also be noted that the sheet material or decorative paper of the bag-like sleeve 11 is adhered to the outer surfaces of guide and support members 13, 14 all the way to the protruding ends thereof so that the paper forming the top and bottom walls 24 and 27 of the wrapper 10 will also extend or protrude beyond the end of the box 12 when it is placed in wrapper 10. It is necessary that the paper sheet material and each of guide and support members 13, 14 protrude beyond the end of box 12 for at least a distance which is greater than one half of the width of the opposite parallel walls 15, 16 in order to completely close open end 26 and completely wrap the box as shown in FIG. 6. For this purpose the guide and support members 13, 14 are made with score or fold lines 28, 29 shown by dot-dash lines in FIGS. 1 and 4 whereby the protruding ends of these members and the wrapping paper adhered thereto can be folded flat juxtaposed against the end of the box to completely enclose it and gift wrap it. As seen in FIGS. 1 and 2, for example, the guide and support members 13, 14 protrude beyond the end of the box 12 further than the top and bottom paper walls 24, 27 whereby a U-shaped cut results in the bag-like sleeve paper at its open end 26. This is because, the portions of the guide and support members 13, 14 which protrude beyond the ends of the top and bottom paper walls 24, 27 are provided to ensure initial, sure and ready guidance for the box 12 to be inserted into the open end 26 of the wrapper 10 without fumble or hesitation by a person inserting same. Also in the case of a rectangular box having ends 30 which are substantially longer than their width, the guide and support member 13, 14 can each protrude beyond the end of the box 12 by a length which is up to a maximum of one half the length of the end 30 or width of the box 12 or up to a maximum of one half the width of walls 24, 27. With this construction the full end 30 of the box 12 can be protected by the protruding ends of members 13, 14 from injury.

At the outside of the protruding end of bottom wall 27 as seen in FIG. 1, there is placed a pressure-sensitive adhesive 31 covered by paper which can be peeled off. Thus when the protruding ends of the paper at the ends of walls 24, 27 are folded down against the end 30 of box 12 to close the open end 26 of wrapper 10, these protruding ends can be adhered to each other, thus eliminating the need for separate tape or glue.

Figure 7:
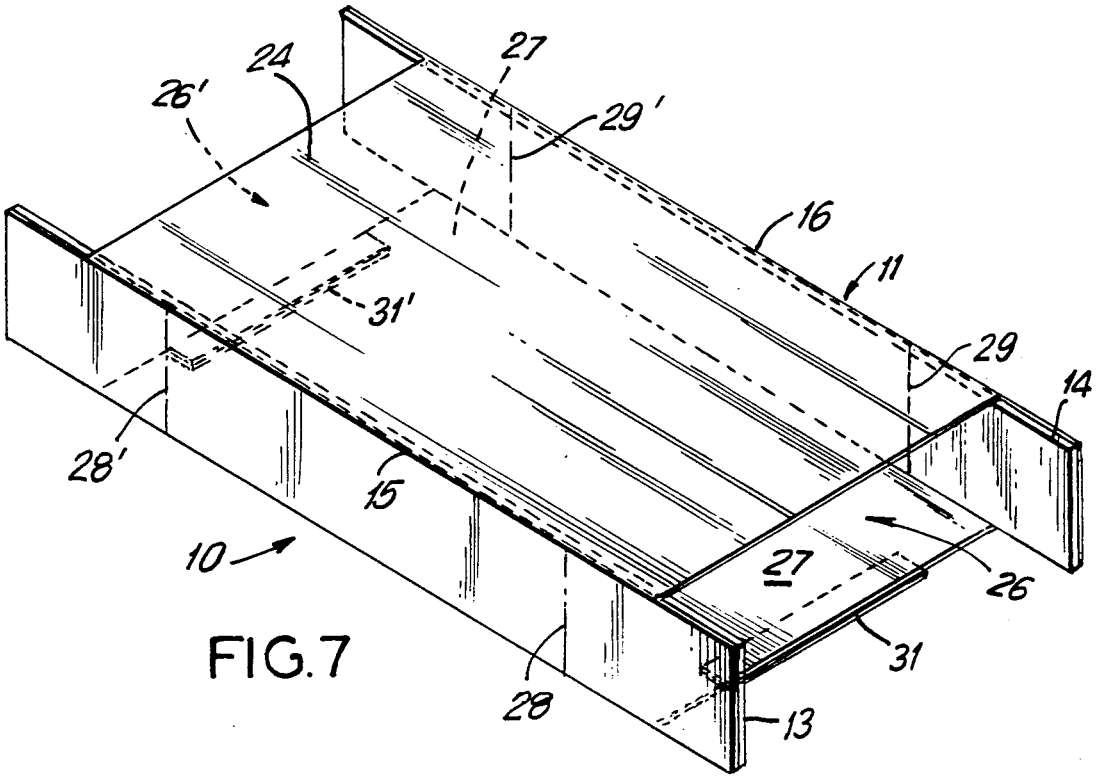
FIG. 7 shows a perspective view of a second embodiment of the gift wrapper of the invention.

FIG. 7 shows a second embodiment of the wrapper 10 of the invention. Like parts of the wrapper shown have the same reference numerals as the first embodiment. As will be evident, instead of fabricating the bag-like sleeve 11 with a closed end opposite open end 26, this end 26' is also open and the construction of the wrapper 10 at this end is identical to that at end 26. Thus guide and support members 13, 14 as well as the paper covering same and forming top and bottom walls, 24, 27 protrude beyond the other end of a box placed in this wrapper to the same extent as they do beyond end 30 of the box as shown in FIG. 2 of the first embodiment. Also to permit the closing of end 26' score or fold lines 28' and 29' are formed in guide and support members 13, 14 at end 26' similar to the score lines 28, 29 in the members at end 26 to facilitate folding of these members. Finally, a pressure-sensitive adhesive 31' covered by paper which can be peeled off is also provided at the outside of the protruding end of bottom wall 27 at end 26' so that the protruding ends of walls 24 and 27 at this end can be adhered to each other and finish closing end 26' similar to end 26. In this embodiment, the box is centered when placed in the gift wrapper, but it has the further advantage that, in addition to the sides of the box, both ends of the box are protected from injury by the guide and support members 13, 14.

Figure 8:
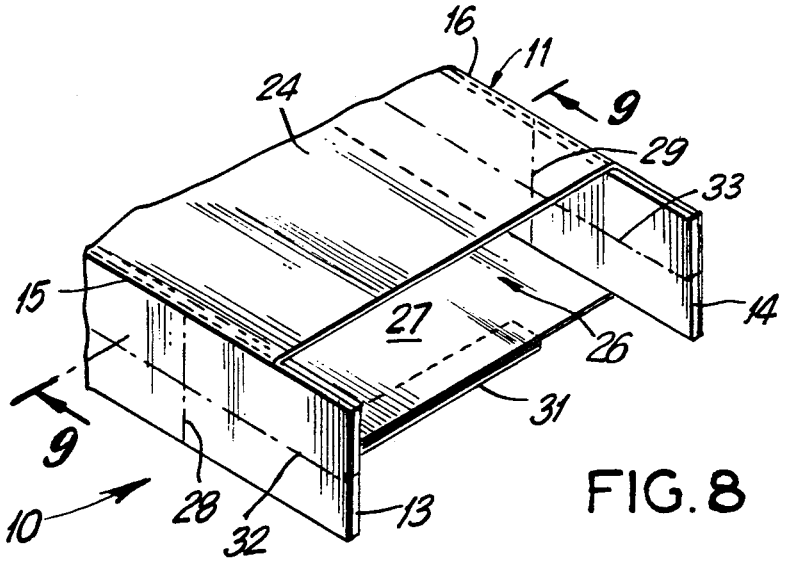
FIG. 8 shows a perspective view of an end of the gift wrapper of the invention illustrating a third embodiment thereof.
Figure 9:
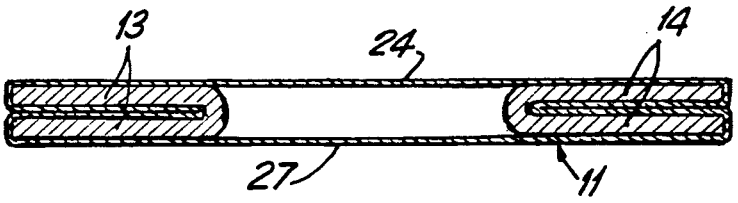
FIG. 9 shows a section of the gift wrapper of the invention shown in FIG. 8 taken on line 9—9 but with the gift wrapper in flattened condition.

FIGS. 8 and 9 show a third embodiment of the gift wrapper 10 of the invention in which like parts of the wrapper shown have the same reference numerals as the first embodiment. This wrapper is identical to the first embodiment except that in addition to the score or fold lines 28 and 29 in guide and support members, these members have score or fold lines 32 and 33 along the length thereof mid-way of their widths as shown by dot-dash lines in FIG. 8. Also this wrapper eliminates score or fold lines 17 and 18 in the top wall 24. This construction permits the wrapper 10 to be folded into a flattened condition for stacking and storage simply by folding guide and support members 13, 14 upon themselves as shown in FIG. 9 which is a sectional view showing the wrapper in flattened condition.

The invention is not limited to the embodiments shown herein. For example, the embodiment of FIG. 1 can be further modified by adhering to the interior surface of the closed end 25 thereof a support member which has a score or fold line extending mid-way along the length thereof similar as shown by lines 32 and 33 in FIG. 8. This will allow the wrapper to still be folded to a flattened condition and also provide protection from injury of the adjacent end of a box which is gift wrapped. Such a construction can also be applied to the closed end of the embodiment of FIG. 8.

Also the embodiment of FIG. 8 can be further modified to provide instead of a closed end opposite to end 26, another open end which is constructed identical to the open end 26 shown in FIG. 8 along the lines of the embodiment of FIG. 7.

We claim:

1. Gift wrapper for use with boxes and like articles having a predetermined length, width and depth, comprising a preformed sleeve made from non-self-supporting wrapping sheet material which when in an operational shape has top and bottom parallel walls connected by a pair of parallel side walls and at least one open end, the width of said top and bottom parallel walls being slightly greater than said predetermined width and the depth of said pair of parallel side walls being slightly greater than said predetermined depth so as to tightly receive one of said boxes in said sleeve, the length of each of said top and bottom parallel walls being at least equal to said predetermined length plus one half said predetermined width and the length of each of said parallel side walls being substantially greater than the length of said top and bottom parallel walls and protrude at the open end of said sleeve, whereby the plane containing the ends of said top and bottom walls together with the planes of said parallel side walls form a U shape, a guide and support member having an entire side thereof secured to the entire length and width of an interior face of each of said parallel side walls, said guide and support members being constructed to provide reinforcement for said parallel side walls and support said sleeve in its operational shape and also are adapted to provide sure, initial and continuous guidance for a box as it is introduced into said sleeve and moved to an end opposite said open end of the sleeve, said guide and support members being scored at a distance from said opposite end of said sleeve which is substantially equal to said predetermined length to enable said guide and support members and wrapping sheet material secured thereto as well as portions of said top and bottom walls to be folded flat juxtaposed against an end of a box in said sleeve and completely enclose same so that the box is gift wrapped, and said sleeve having score or fold lines located so that said sleeve can be folded from said operational shape into a flattened condition.

2. Gift wrapper according to claim 1, wherein said sleeve is bag-like when said sleeve is in its operational shape and the end of said sleeve opposite said open end is closed by said wrapping sheet material.

3. Gift wrapper according to claim 2, wherein, when said sleeve is in its operational shape, said score or fold lines are positioned on said closed end and one of said top and bottom walls of said sleeve.

4. Gift wrapper according to claim 1, wherein said guide and support members are scored along the entire length thereof to enable said sleeve to be folded into said flattened condition thereof.

5. Gift wrapper according to claim 1, wherein the length of each of said parallel side walls and guide and support members secured thereto is equal to said predetermined length plus up to a maximum of one half said predetermined width.

6. Gift wrapper according to claim 1, wherein said opposite end of said sleeve is also open, the length of each of said top and bottom parallel walls is at least equal to said predetermined length plus said predetermined width with one half of said predetermined width extending at each open end of the sleeve, and each of said parallel side walls and the guide and support members secured thereto also protrude at said open opposite end of said sleeve so that the plane containing the ends of said top and bottom walls together with the planes of said parallel side walls form a U shape at said open opposite end of said sleeve and adapted to also provide sure, initial and continuous guidance for a box upon introduction thereof into said open opposite end of said sleeve, and said guide and support members being also scored at said opposite end of said sleeve to enable the protruding ends of said guide and support members and wrapping sheet material secured thereto as well as portions of said top and bottom walls at said opposite end of said sleeve to be folded flat juxtaposed against a second end of the box in said sleeve.

7. Gift wrapper according to claim 1, wherein adhesive means are provided at the end of one of said top and bottom parallel walls for adhesively joining them together when said guide and support means and wrapping sheet material are folded flat juxtaposed against said end of the box.

* * * * *